United States Patent [19]

Tomisawa

[11] Patent Number: 4,615,319

[45] Date of Patent: Oct. 7, 1986

[54] APPARATUS FOR LEARNING CONTROL OF AIR-FUEL RATIO OF AIRFUEL MIXTURE IN ELECTRONICALLY CONTROLLED FUEL INJECTION TYPE INTERNAL COMBUSTION ENGINE

[75] Inventor: Naoki Tomisawa, Takasaki, Japan

[73] Assignee: Japan Electronic Control Systems Co., Ltd., Japan

[21] Appl. No.: 604,025

[22] Filed: Apr. 26, 1984

[30] Foreign Application Priority Data

May 2, 1983 [JP] Japan ..... 58-076221
May 2, 1983 [JP] Japan ..... 58-076222

[51] Int. Cl.[4] ..... F02B 3/00
[52] U.S. Cl. ..... 123/440; 123/486
[58] Field of Search ..... 123/440, 480, 478, 486, 123/489

[56] References Cited

U.S. PATENT DOCUMENTS

| | | | |
|---|---|---|---|
| 3,483,851 | 12/1969 | Reichardt | 123/478 |
| 3,750,632 | 8/1973 | Zechnall | 123/478 |
| 4,200,064 | 4/1980 | Engele | 123/480 |
| 4,235,204 | 11/1980 | Rice | 123/440 |
| 4,284,050 | 8/1981 | Suchowerskyj et al. | 123/478 |
| 4,309,971 | 1/1982 | Chiesa | 123/478 |
| 4,401,087 | 8/1983 | Ikeura | 123/480 |
| 4,411,232 | 10/1983 | Atago | 123/480 |
| 4,413,601 | 11/1983 | Matsuoka | 123/480 |
| 4,416,237 | 11/1983 | Aoki | 123/480 |

*Primary Examiner*—Ronald B. Cox

*Attorney, Agent, or Firm*—Lowe, Price, LeBlanc, Becker & Shur

[57] ABSTRACT

The present invention relates to a learning control apparatus for controlling the air-fuel ratio in an electronic control fuel injection type internal combustion engine wherein the injection quantity ($Ti=Tp\times K\times\alpha$) is basically operated by multiplying the basic injection quantity (Tp), determined from the flow amount of sucked air and the rotation speed, by the air-fuel ratio feedback correction coefficient ($\alpha$), and the feedback control of the air-fuel ratio to the aimed target air-flow ratio is performed on the thus operated injection quantity Ti. However, as it takes long time to control the air-fuel ratio to the target air-flow ratio by the feedback control of the integration if the basic air-fuel ratio at the time of $\alpha=1$ deviates from the aimed at air-fuel ratio, the value $\alpha$ at the time in the stationary driving condition and the driving condition per se, are detected, the learning correction coefficient $\alpha o$ prestored in RAM corresponding to the engine condition is renewed to the new learning correction coefficient $\alpha o$new by an operation based on the stored $\alpha o$ and the detected feedback correction coefficient $\alpha$, and the next injection quantity is operated by the equation $Ti=Tp\times K\times\alpha o\times\alpha$ thereby the feedback correction coefficient $\alpha$ could be small. In addition, at the time of acceleration or deceleration of the engine, the acceleration or deceleration correction coefficient Kacc, Kdcl included in constant K is corrected by learning corresponding to the engine driving state, Kacc and Kdcl are pre-stored in RAM and renewed the detected new Kacc and Kdcl, the renewed data is used for the subsequent operation of Ti.

18 Claims, 9 Drawing Figures

100
25
C1
204
OPERATION
T
203
201
Tp
Tp OPERATION
202
α
α SETTING
αo
αo RETRIEVAL
αo RAM
αo RENEWAL
STATIONARY STATE
208
206
205
207
S1(Q)
S4,S5(N)
S3
S2
S8
S9
S10
S11
S6
S7
21
31
26
24
37
41
42
43
33
35

START
Tp ← K × Q/N
S121
COEF SETTING
S122
Ts SETTING
S123
ΔTH CONST
S124
NO
YES
FLAG A = 1
S125
α SETTING
S126
α0 CORRECTION SUBROUTINE
S127
α0 RETRIEVAL
S128
S129
Ti←TpxCOEF x α x α0+Ts
Ti OUTPUT
S130
S132
FLAG A = 0
S133
Kacc, Kdcℓ RETRIEVAL
S134
α CLAMPING
ΔTH > 0
>0
<0
S135
S136
S137
FLAG B = 1
FLAG B = 0

APPARATUS FOR LEARNING CONTROL OF AIR-FUEL RATIO OF AIRFUEL MIXTURE IN ELECTRONICALLY CONTROLLED FUEL INJECTION TYPE INTERNAL COMBUSTION ENGINE

FIELD OF THE INVENTION

The present invention relates to an apparatus for controlling the air-fuel ratio of an air-fuel mixture in an internal combustion engine provided with fuel injection means opened and closed in an on-off manner by a driving pulse signal given by electronic control means. More particularly, the present invention relates to an air-fuel ratio controlled by the apparatus in which the quantity of the air-fuel ratio controlled by the apparatus is learned and the respondency of the control of the air-fuel ratio in the same engine-driving state is improved.

BACKGROUND OF THE INVENTION

An electronically controlled fuel injection valve is opened by a driving pulse signal (injection pulse) given synchronously with the rotation of an engine and while the valve is opened, a fuel is injected under a predetermined pressure.

Accordingly, the injection quantity of the fuel depends on the period of opening of the valve, that is, the injection pulse width. Assuming that this pulse width is expressed as Ti and is a control signal corresponding to the injection quantity of the fuel, Ti is expressed by the following equations:

$$Ti = Tp \times COEF \times \alpha + Ts \text{ and } Tp = K \quad Q/N$$

wherein Tp stands for the injection pulse width corresponding to the basic injection quantity of the fuel, which is called "basic fuel injection quantity" for convenience, K stands for a constant, Q stands for the flow quantity of air sucked in the engine, N stands for the rotation speed of the engine, COEF stands for various correction coefficients for cerrecting the quantity of the fuel, which is expressed by the following formula:

$$COEF = 1 + Ktw + Kas + Kai + Kmr + Kacc + Kdcl$$

in which Ktw stands for a coefficient for increasing the quantity of the fuel as the water temperature is lower, Kas stands for a correction coefficient for increasing the quantity of the fuel at and after the start of the engine, Kai stands for a correction coefficient for increasing the quantity of the engine after a throttle valve arranged in an intake passage of the engine is opened, Kmr stands for a coefficient for correcting the air fuel mixture, Kacc stands for a correction coefficient for increasing the quantity of the fuel at the time of acceleration of the engine and Kdcl stands for a correction coefficient for decreasing the quantity of the fuel at the time of deceleration of the engine, $\alpha$ stands for an air-fuel ratio feedback correction coefficient for the feedback control ($\lambda$ control), described hereinafter, of the air-fuel ratio of the air-fuel mixture, and Ts stands for the quantity of the voltage correction for correcting the change of the flow quantity of the fuel injected by the fuel injection valve, which is caused by the change of the voltage of a battery.

In short, the desired injection quantity of the fuel is obtained by multiplying the basic fuel injection quantity Tp by various correction coefficients COEF, and when a difference is brought about between the targeted, or aimed at value to be attained by the control and the actual controlled value, this difference is multiplied by $\alpha$ to effect the feedback control and the correction for the power source voltage is added to the feedback control.

The feedback control of the air-fuel ratio will now be described. An exhaust component concentration detecting member, for example, and $O_2$ sensor for detecting the oxygen component in the exhaust gas, is attached to an exhaust passage to detect the actual air-fuel ratio $\lambda$ of the air-fuel mixture sucked in the engine, and by comparing with a slice level, it is judged whether the actual air-fuel ratio $\lambda$ is richer or leaner than the target air-fuel ratio $\lambda t$. When a known ternary catalyst for efficiently convertion CO, HC and NOx, the main three exhaust gas components, at the theoretical air-fuel ratio is arranged in the exhaust system, the above-mentioned aimed at air-fuel ratio $\lambda t$ is equal to the theoretical air-fuel ratio. Accordingly, in this case, by the slice level, it is judged whether the actual air-fuel ratio is richer or leaner than the theoretical air-fuel ratio, and the injection fuel quantity expressed by $Tp \times COEF$ is increased or decreased and controlled so that the actual air-fuel ratio becomes equal to the theoretical air-fuel ratio. For this control, the air-fuel ratio feedback correction coefficient $\alpha$ is set and the injection quantity $Tp \times COEF$ is multiplied by $\alpha$.

If it is intended to effect the feedback correction at a time by abruptly changing the value of the air-fuel feedback correction coefficient $\alpha$, the theoretical air-fuel ratio is overshot or undershot, and therefore, the value of the air-fuel ratio feedback correction coefficient is changed by the proportion and integration (PI) control so that the air-fuel ratio is stably controlled.

More specifically, in the case where the output of the $O_2$ sensor is higher or lower than the slice level, the air-fuel ratio is not abruptly leaned or riched, but in the case where the air-fuel ratio is rich (lean), the air-fuel ratio is first decreased (increased) only by the proportional (P) component, and is then gradually decreased (increased) by the integration (I) component unit so that the air-fuel ratio is leaned (riched). The P component is set at a value sufficiently larger than the I component unit.

In the region where the air-fuel ratio feedback control is not performed, the value of $\alpha$ is clamped to 1 or a constant value.

Needless to say, if the base air-fuel ratio in the region where the air-fuel ratio feedback control is effected, that is, the air-fuel ratio at the time when $\alpha$ is equal to 1, is set at the theoretical air-fuel ratio ($\alpha = 1$) through the entire region, the feedback control is inherently unnecessary. Practically, however, even if the base air-fuel ratio is set at $\lambda = 1$ in a specific driving state, the air-fuel ratio is ordinarily deviated from the theoretical air-fuel ratio in other driving states because of deviations or changes with the lapse of time among constituent members (such as an air flow meter, a fuel injection valve, a pressure regulator and a control unit), the non-linearity of the pulse width-flow amount characteristic of the fuel injection valve and changes of the driving conditions and environments. In this region where the deviation of the base air-fuel ratio occurs, the air-fuel ratio feedback control is performed so that this deviation is eliminated. This air-fuel ratio feedback correction control is disclosed in, for example, U.S. Pat. No. 4,284,050.

However, in this air-fuel ratio feedback control, for example, when one stationary driving region is greatly changed to a different stationary driving region, the base air-fuel ratio in this different stationary driving region is greatly deviated from $\lambda=1$ and it takes too long a time to perform the PI control of the change of the base air-fuel ratio generated by this deviation to $\lambda=1$ by the feedback control. More specifically, even though the base air-fuel ratio has been obtained from the specific injection quantity $Tp \times COEF$ and the deviation of this air-fuel ratio from the theoretical air-fuel ratio has been corrected by the PI control based on $\alpha$, since the base air-fuel ratio is greatly changed, the base air-fuel ratio is controlled to a value greatly different from $\lambda=1$ if $Tp \times COEF$ used up to this time is still used, and the feedback correction by similar PI control should be performed and it takes a long time to correct the base air-fuel ratio to $\lambda=1$ by the feedback correction. In order to eliminate this disadvantage, it is necessary to improve the respondency of the control by increasing the PI constant. However, if the control respondency is thus improved, overshooting or undershooting is readily caused and the control performance is degraded. Namely, when the base air-fuel ratio is greatly deviated from $\lambda=1$, the control of the air-fuel ratio is effected in the region separate greatly from the theoretical air-fuel ratio.

Consequently, the driving is carried out in the range where the conversion efficiency of the ternary catalyst is low, and therefore, increase of the cost by increase of the amount of the noble metal in the catalyst is caused and the catalyst should be exchanged with new one frequently because of further reduction of the conversion efficiency due to deterioration of the catalyst.

The acceleration correction coefficient Kacc and deceleration correction coefficient Kdcl of COEF involve problems similar to those described above with respect to $\alpha$. As taught in, for example, U.S. Pat. No. 3,483,851 and U.S. Pat. No. 3,750,632, the fuel injection quantity is increased at the time of acceleration of the engine and the fuel injection quantity is decreased at the time of deceleration of the engine. However, in a so-called single point injection system where one fuel injection valve is arranged in an engine, for example, upstream of a throttle valve, at the time of acceleration of the engine, a part of the fuel increased for acceleration adheres to the wall of the intake passage and a response delay is caused in substantial increase of the injection quantity of the fuel for acceleration. Furthermore, at the time of deceleration of the engine, since the fuel adhering to the wall of the intake passage is sucked in the engine, even if the injection quantity of the fuel is decreased, the quantity of the fuel sucked in the engine is not promptly decreased. Accordingly, the respondency is reduced at the time of acceleration or deceleration of the engine. This increase or decrease of the fuel at the time of acceleration or deceleration has a considerable influence on the fuel ratio at the transient driving, and hence, the above-mentioned air-fuel ratio feedback control is adversely affected. Accordingly, at the time of acceleration or deceleration, $\alpha$ is clamped to 1 or a certain value to stop the air-fuel ratio feedback control and so-called feedforward control of obtaining a fuel injection quantity corresponding to the base air-fuel ratio by multiplying Tp by Kacc or Kdcl is performed. However, if the same Kacc or Kdcl is always used, because of deviations of constituent members of the engine, changes with the lapse of time and environmental changes, necessary increase or decrease of the fuel quantity for acceleration or deceleration is not performed when a great change is produced in the air-fuel ratio according to the driving state.

SUMMARY OF THE INVENTION

It is a primary object of the present invention to eliminate the above-mentioned disadvantages, and according to the present invention, the control quantity once controlled is learned and the respondency of the air-fuel ratio control is increased.

According to the present invention, the air-fuel ratio feedback control is first effected and learned. More specifically, when the base air-fuel ratio is deviated from the aimed air-fuel ratio, since the feedback correction coefficient $\alpha$ is increased during this transition stage so as to make up the gap, the driving state and $\alpha$ at this time are detected, and the learning correction coefficient $\alpha o$ based on this $\alpha$ is determined and stored. When the same driving state is brought about again, the base air-fuel ratio is corrected based on the stored learning correction coefficient $\alpha o$ so that the respondency to the aimed at air-fuel ratio $\lambda t$ is enhanced. According to the present invention, there is provided a learning control apparatus for effecting the above-mentioned learning and control.

In the present invention, according to the above-mentioned control apparatus, the deviation of the base air-fuel ratio from the targeted air-fuel ratio $\lambda t$ due to the change of the base air-fuel ratio at the transient stage is eliminated and $\alpha$ is diminished to improve the control respondency. Furthermore, it is made possible to lessen the integration constant adopted for increasing or decreasing the fuel, injection quantity for attaining the aimed at air-fuel ratio $\lambda t$, whereby overshooting or undershooting is prevented and the control characteristics are improved.

In the present invention, when a ternary catalyst is arranged in the exhaust system, the aimed at air-fuel ratio $\lambda t$ is set at the theoretical air-fuel ratio, whereby the conversion efficiency of the ternary catalyst is improved and effects of protecting the catalyst and reducing the cost are attained.

The above-mentioned objects and effects of the present invention can be attained by an apparatus for learning control of the air-fuel ratio of an air-fuel mixture in an electronically controlled fuel injection type internal combustion engine, which comprises means for detecting the driving state of the engine, which includes at least first detecting means for detecting the flow quantity Q of air sucked in the engine, second detecting means for detecting the rotation speed N of the engine and third detecting means for detecting the concentration of the exhaust component for detecting the actual air-fuel ratio $\lambda$ of the air-fuel mixture sucked in the engine, fuel injection means for injecting and supplying a fuel to the engine in an on-off manner in response to a driving pulse signal, basic fuel injection quantity operating means for operating a basic injection quantity Tp of the fuel to be supplied to the engine based on the flow quantity Q of air sucked in the engine, which is put out by said first detecting means, and the engine rotation speed N put out by said second detecting means, random access memory means in which the learning correction coefficient $\alpha o$ for correcting said basic fuel injection quantity Tp is stored in advance according to the driving state of the engine, learning correction coefficient retrieval means for retrieving the learning correction coefficient αo from said random access memory means according to the actually detected driving state of the engine, feedback correction coefficient setting means for increasing or decreasing by at least a predetermined integration component unit the feedback correction coefficient αo so that the actual air-fuel ratio λ put out by said third detecting means is brought close to the present aimed at air-fuel ratio λt, learning correction coefficient renewal means for setting a new learning correction coefficient, which is operated based on the feedback correction coefficient α set by said feedback correction coefficient setting means and the learning correction coefficient αo retrieved by said learning correction coefficient retrieval means according to the detected driving state of the engine, as the corresponding learning correction coefficient αo of said memory means, fuel injection quantity operating means for operating a fuel injection quantity Ti by correcting the basic fuel injection quantity Tp based on the retrieved or retrieved and renewed learning correction coefficient αo and also based on the feedback correction coefficient α set by said feedback correction coefficient setting means, and driving pulse signal output means for putting out the driving pulse signal corresponding to the fuel injection quantity Ti to said fuel injection means.

In the present invention, since the acceleration or deceleration correction coefficient Kacc or Kdcl has a considerable influence on the air-fuel ratio control at the time of acceleration or deceleration, even if learning of the base air-fuel ratio is advanced at the feedback control of the air-fuel ratio, it is considered that the effect of correcting the base air-fuel ratio in such an acceleration or deceleration region is low. Accordingly, in the present invention, in connection with the control of the air-fuel ratio at the subsequent acceleration or deceleration in the same driving state, which is performed by learning and storing the corrected acceleration or deceleration correction coefficient Kacc or Kdcl obtained by increasing or decreasing and correcting the acceleration or deceleration correction coefficient Kacc or Kdcl giving the actual air-fuel ratio based on the comparison of the detected actual air-fuel ratio at the time of acceleration or deceleration, an air-fuel ratio learning control apparatus for performing said air-fuel ratio control at the subsequent acceleration or deceleration by using the stored acceleration or deceleration correction coefficient is added to the above-mentioned air-fuel ratio learning control apparatus for the feedback control of the air-fuel ratio.

In the present invention, according to this feature, also at the time of acceleration or deceleration when the feedback control of the air-fuel ratio is not effected, the response characteristics for acceleration or deceleration are improved and the air-fuel ratio control characteristics are enhanced through the entire driving region.

This air-fuel ratio learning control apparatus of the present invention comprises, in addition to the above-mentioned air-fuel ratio learning control apparatus for the feedback control, means for detecting the acceleration of the engine, means for stopping the feedback control when said detecting means detects acceleration or deceleration, random access second memory means in which acceleration and deceleration correction coefficients Kacc or Kdcl for increasing or decreasing and correcting the fuel injection quantity at the time of acceleration or deceleration according to the driving state of the engine are stored in advance, acceleration and deceleration correction coefficient retrieval means for retrieving the acceleration or deceleration correction coefficient Kacc or Kdcl from said second memory means according to the driving state of the engine when acceleration or deceleration of the engine is detected, fuel injection quantity operating means for operating the fuel injection quantity Ti by correcting the basic fuel injection quantity Tp based on αo, α and the retrieved acceleration or deceleration correction coefficient Kacc or Kdcl, air-fuel ratio deciding means for computing the air-fuel ratio of the air-fuel mixture at the time when acceleration or deceleration of the engine is detected and comparing the operated air-fuel ratio with the aimed air-fuel ratio corresponding to the driving state of the engine, and acceleration and deceleration correction coefficient renewal means for renewing the acceleration or deceleration correction coefficient to the new acceleration or deceleration correction coefficient corresponding to the driving state of the engine, which is stored in said second memory means, based on the result of the decision made by said deciding means so that the deviation of the computed air-fuel ratio from the aimed air-fuel ratio is eliminated.

The characteristic features and functional effects of the present invention will now be described in detail with reference to the following embodiments illustrated in the accompanying drawings.

DETAILED DESCRIPTION OF THE PREFERRED EMBODIMENTS

Figure 1:
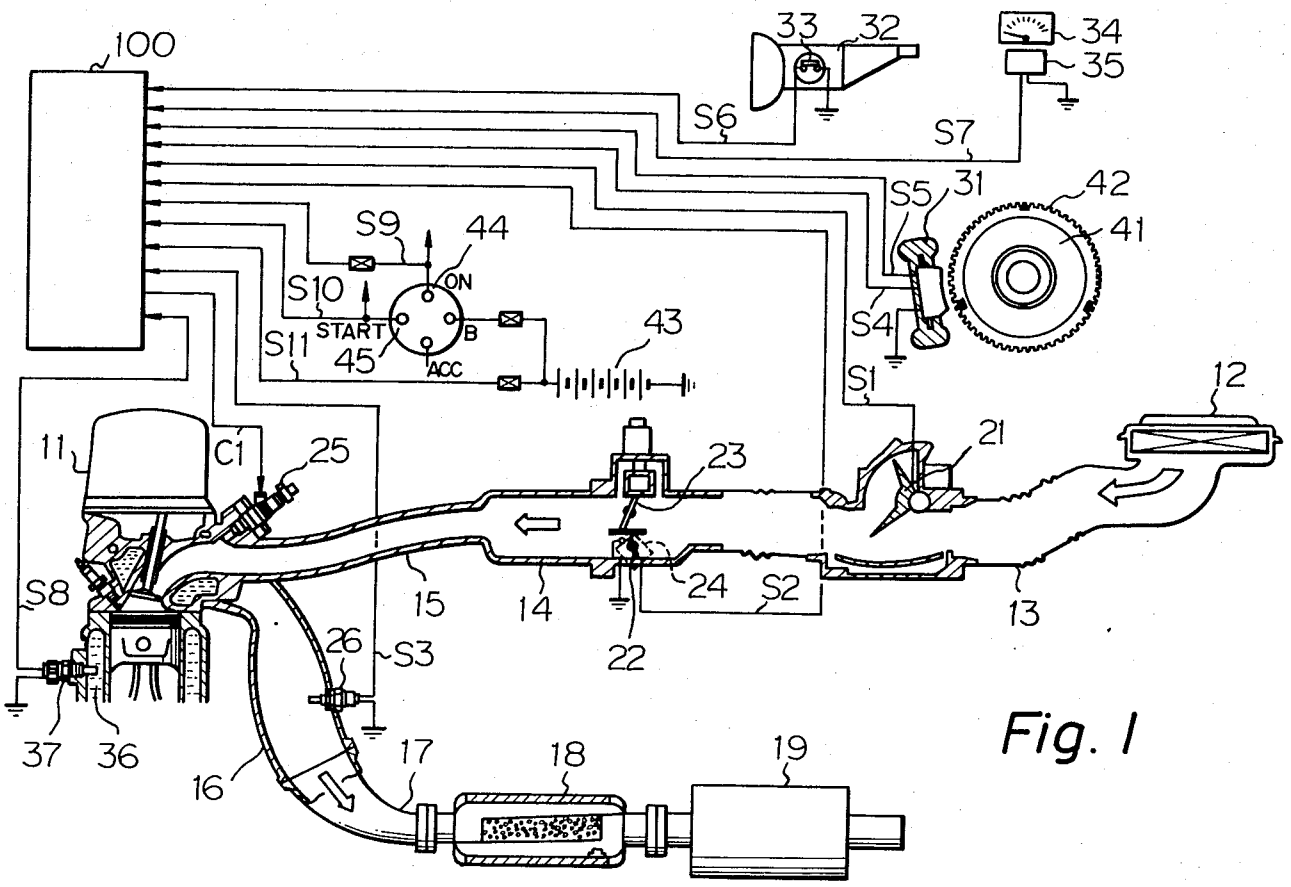
FIG. 1 is a schematic view illustrating an air-fuel ratio learning control apparatus according to one embodiment of the present invention.

Referring to FIG. 1, air is sucked in an engine 11 through an air cleaner 12, an intake duct 13, a throttle chamber 14 and an intake manifold and an exhaust gas is discharged through an exhaust manifold 16, an exhaust duct 17, a ternary catalyst 18 and a muffler 19.

An air flow meter 21 is arranged in the intake duct 13 to put out a signal S1 of a flow quantity Q of air sucked in the engine. In the throttle chamber 14, a primary side throttle valve 22 interconnected with an accelerator pedal (not shown) and a secondary side throttle valve 23 are arranged to control the sucked air flow quantity Q. A throttle sensor 24 of the variable resistor type is attached to a throttle shaft of the primary side throttle valve 22 to put out an electric current signal S2 corresponding to a change of the electric resistance corresponding to the turning angle, that is, the opening degree, of the throttle valve 22. An idle switch which is turned on when the throttle valve 22 is fully closed is mounted on the throttle sensor 24. A fuel injection valve 25 mounted on the intake manifold 15 or an intake port of the engine 11 is an electromagnetic fuel injection valve which is opened on actuation through a solenoid and is closed on deenergization. Namely, the valve 25 is actuated and opened through the solenoid by a driving pulse signal C1 to inject and supply into the engine a fuel fed under pressure from a fuel pump (not shown).

An $O_2$ sensor 26 acting as means for detecting the concentration of an exhaust component is arranged in the exhaust manifold 16. The $O_2$ sensor 26 is a known sensor which puts out a voltage signal S3 corresponding to the ratio of the oxygen concentration in the exhaust gas to air and the electromotive force of which is abruptly changed when an air-fuel mixture is burnt at the theoretical air-fuel ratio. Accordingly, the $O_2$ sensor is means for detecting the air-fuel ratio of the air-fuel mixture. The ternary catalyst 18 is a catalytic device for oxidizing or reducing CO, HC and NOx in the exhaust gas component at a high efficiency at an air-fuel ratio close to the theoretical air-fuel ratio of the air-fuel mixture to convert them to harmless substances.

These air flow meter 21, throttle sensor 24 and $O_2$ sensor 26 constitute parts of means for detecting the driving state of the engine or engine parameters and detection signals S1 through S3 of said detecting means are put out into a control unit 100. The means for detecting the driving state of the engine, which puts out these detection signals to the control unit 100, comprises, in addition to the above-mentioned members, a crank angle sensor 31, a neutral switch 33 mounted on a transmission 32, a car speed sensor 35 mounted on a speed meter 34 of a car, and water temperature sensor 37 for detecting the temperature of cooling water in a water jacket 36 for cooling the engine or cooling water in a thermostat housing of the cooling water circulation system. The crank angle sensor 31 is arranged to detect a rotation speed N of the engine and a crank angle (piston position), and a signal disc plate 42 is mounted on a crank pulley 41 and the crank angle sensor 31 puts out a reference signal S4 by, for example, every 180° in the crank angle and a position signal S5 by, for example, every 1° in the crank angle according to teeth formed on the periphery of the plate 42. When the transmission 32 is set at the neutral position, the neutral switch 33 detects this and puts out a signal S6. The car speed sensor 35 detects the car speed and puts out a car speed signal S7. The water temperature sensor 37 puts out a voltage signal S8 changing according to the change of the temperature of cooling water corresponding to the temperature of the engine.

The means for detecting the driving state of the engine further comprises an ignition switch 44 and a start switch 45. The ignition switch 44 is a switch for applying a voltage of a battery 43 to an ignition device and putting out an on-off signal S9 to the control unit 100. The start switch 45 is a switch which is turned on when a starter motor is driven to start the engine and which puts out an on-off signal S10. The terminal voltage of the battery 43 is put out to the control unit 100 by a signal S11.

The detection signals S1 through S11 emitted from the respective elements of the means for detecting the driving state of the engine are put in to the control unit 100 where the operation processing is carried out to put out a signal C1 of an optimum injection pulse width to the fuel injection valve and obtain a fuel injection quantity giving an optimum air-fuel ratio.

Figure 2:
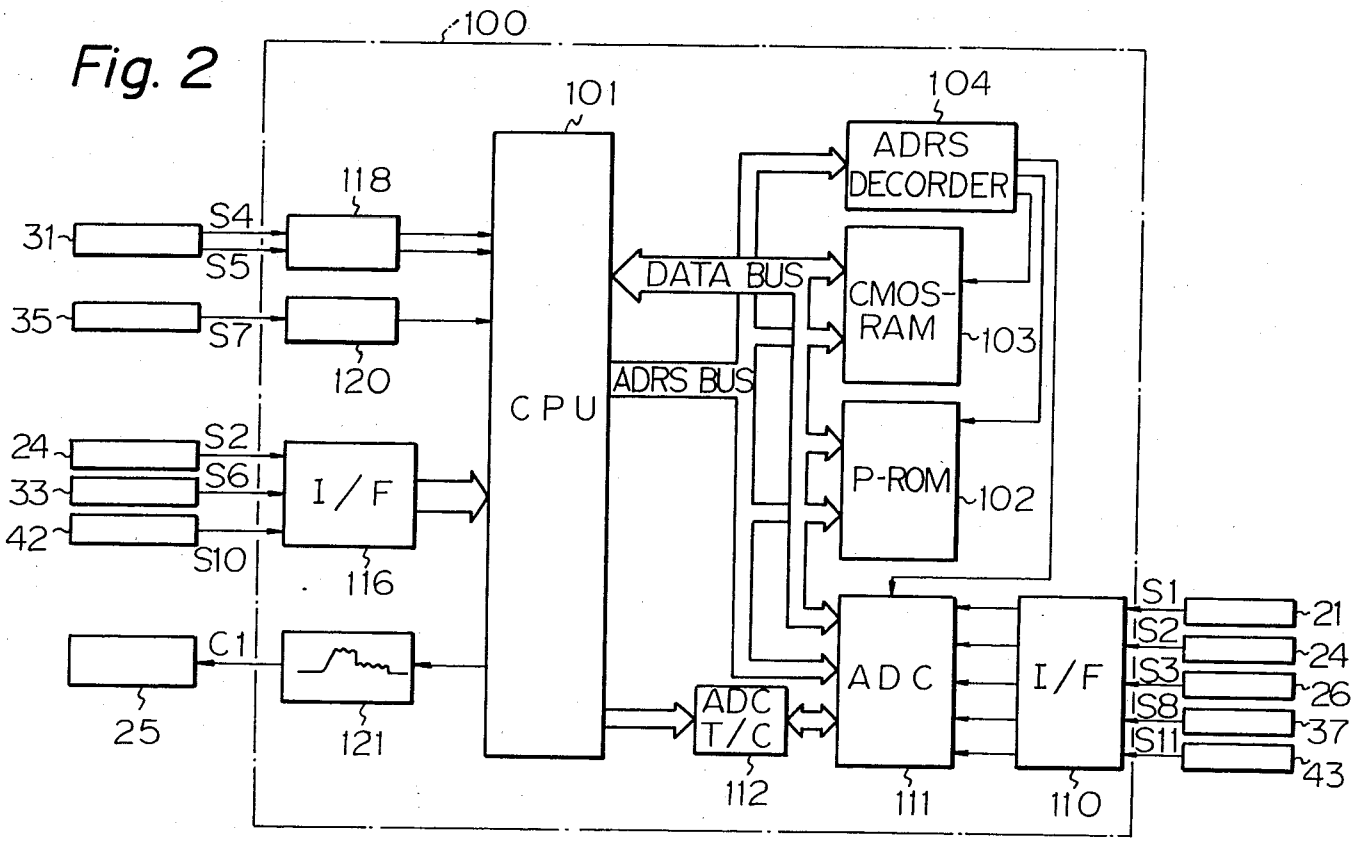
FIG. 2 is a block diagram showing a hardware structure of a control unit used in the embodiment of the present invention.

As shown in FIG. 2, control unit 100 comprises CPU 101, P-ROM 102, CMOS-RAM 103 for the learning control of the air-fuel ratio and an address decoder 104. A back-up power source circuit is used for RAM 103 to retain the content of the memory after the ignition switch 41 has been turned off.

As analogue input signals to be put in CPU 101 for the control of the fuel injection quantity, there can be mentioned the signal S1 of the sucked air flow quantity Q from the air flow meter 21, the throttle opening degree signal S2 from the throttle sensor 24, the water temperature signal S8 from the water temperature sensor 37, the signal S3 of the oxygen concentration in the exhaust gas from the $O_2$ sensor 26 and the battery voltage signal S11. These signals are put in CPU 101 through an analogue input interface 110 and an A/D converter 111. The A/D converter 111 is controlled by CPU 101 through an A/D conversion timing controller 112.

As a digital input signals, there can be mentioned the idle switch signal S2 which puts out ON signal at the throttle valve 22 fully closed, and ON-OFF signals S10 and S6 supplied from the start switch 42 and the neutral switch 33. These signals are put in CPU 101 by way of a digital input interface 116.

Furthermore, for example, the reference signal S4 and position signal S5 from the crank angle sensor 31 are input to CPU 101 through a one-shot multichip circuit 118. Moreover, the car speed signal S7 from the car speed sensor 35 is put in CPU 101 through a wave shaping circuit 120.

The output signal from CPU 101 (driving pulse signal to the fuel injection valve) is supplied to the fuel injection valve 25 through a current wave control circuit 121.

Figure 3:
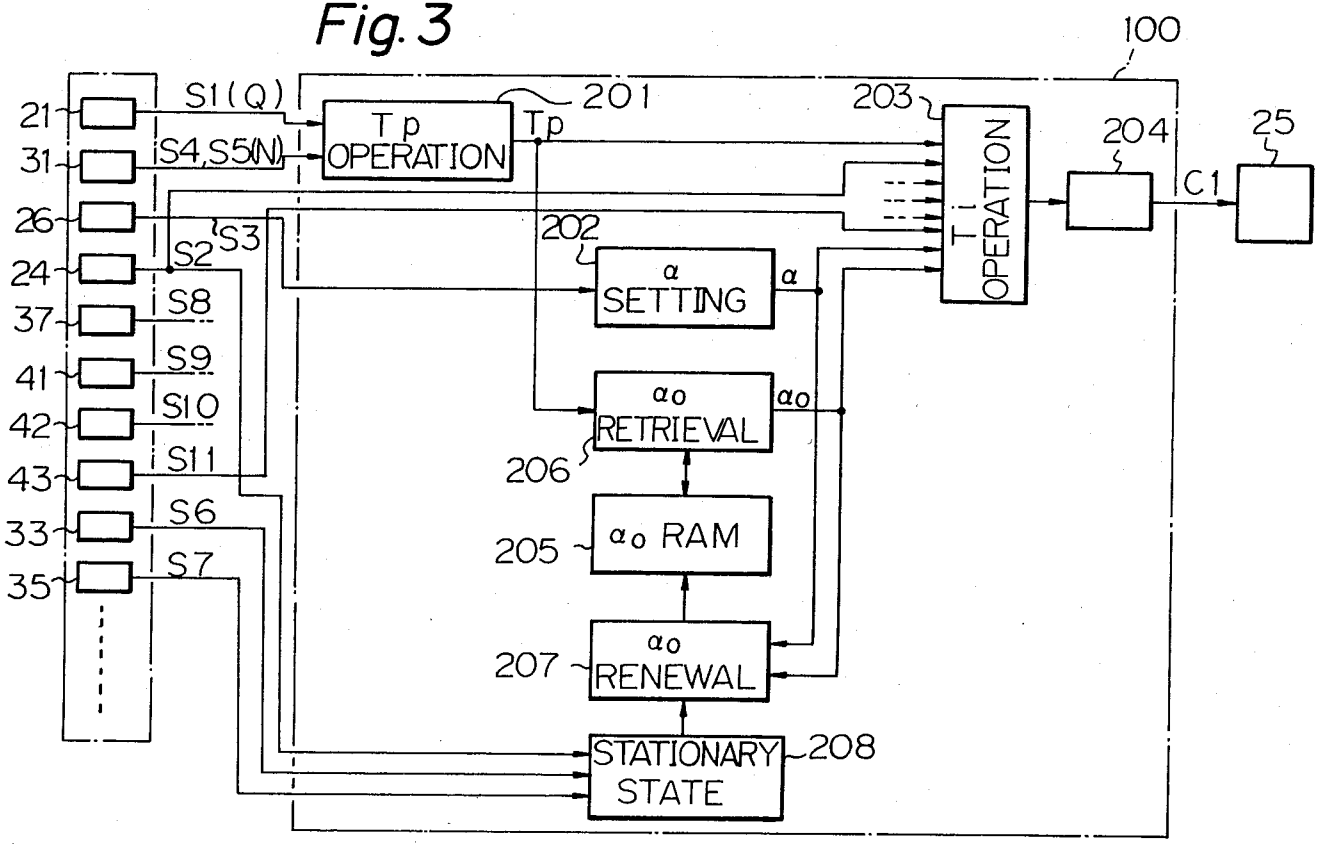
FIG. 3 is a block diagram in the air-fuel ratio learning control apparatus of the embodiment of the present invention at the time of the feedback control of the air-fuel ratio.
Figure 4:
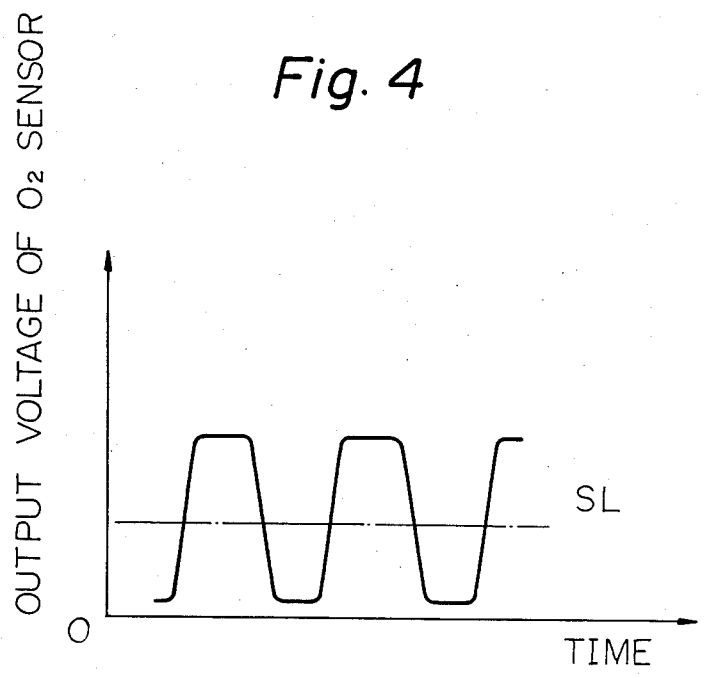
FIG. 4 is a graph showing the output voltage characteristics of an $O_2$ sensor.

CPU 101 performs the input and output operations and computing processing according to the program based on the block diagram of FIG. 3 and the flow chart of FIG. 4 (this program is stored in ROM 102) to control the fuel injection quantity.

Referring to FIG. 3, basic fuel injection quantity operating means 201 arithmetically operates the injection pulse signal Tp corresponding to the basic fuel injection quantity according to the equation of $Tp=K.Q/N$ based on the signal S1 of the sucked air flow quantity detected by the air flow meter 21 and the signals S4 and S5 of the engine rotation speed N detected by the rank angle sensor 31.

Air-fuel ratio feedback correction coefficient setting means 202 receives an output voltage signal S3, as shown in FIG. 4, which is put from the $O_2$ sensor 26 and corresponds to the actual air-fuel ratio $\lambda^2$ determined by the oxygen concentration in the exhaust gas, and said setting means 202 judges by comparing means whether the actual air-fuel ratio is richer or leaner than the slice level voltage SL as the aimed at air-fuel ratio $\lambda t$, and so as to bring the actual air-fuel ratio close to $\lambda t$, said setting means 202 sets the air-fuel ratio feedback correction coefficient $\alpha$ by increasing or decreasing the feedback quantity by the proportional component (P) and the predetermined integration component unit (I). Ordinarily, the initially set value of $\alpha$ is 1.

Fuel injection quantity operating means 203 receives the Tp signal put out from the basic fuel injection quantity operating means 201, the signal of the air-fuel ratio feedback correction coefficient $\alpha$ from the air-fuel ratio feedback correction coefficient setting means 202 and various detection engine parameters S3, S2, S8, S9, S10 and S11 put out from various means for detecting the driving state of the engine 24, 37, 41 and 43, and said operating means 203 puts out a fuel injection quantity (pulse) signal Ti according to the equations of $Ti=Tp\times COEF\times\alpha Ts$, and $COEF=1+Ktw+Kas+Kai+Kmr$.

Driving pulse signal output means 204 puts out a driving pulse signal C1 corresponding to the fuel injection quantity Ti to the fuel injection valve 25, and the fuel is injected into the engine from the fuel injection valve 25 in such an amount that the desired theoretical air-fuel ratio $\lambda t$ is attained. The stages described hereinbefore are well known.

Memory means 205 consists of random access memory (RAM) 103 in which the learning correction coefficient $\alpha o$ for correcting the basic fuel injection quantity Tp is stored in advance according to the driving state of the engine. The initially set value of $\alpha o$ is 1. It is difficult to set the air-fuel ratio of $\alpha=1$, that is, the base air-fuel ratio at the theoretical air-fuel ratio, through the entire region. Practically, even if the base air-fuel can be set at 1 in a specific driving state, the air-fuel ratio is deviated from the theoretical air-fuel ratio in other driving state because of dimensional deviations of the constituent members, changes of these members with fthe lapse of time, the non-linearity of the pulse width-flow amount characteristic of the fuel injection valve and changes of the driving conditions and environments. The air-fuel ratio feedback correction coefficient $\alpha$ is determined so that the deviation is eliminated in the region where the deviation is caused. However, in the case where the value $\alpha$ is too large, that is, the deviation of the air-fuel ratio from the theoretical air-fuel ratio is too large and the value of $\alpha$ for eliminating this deviation is too large, it takes too long a time to change the air-fuel ratio to $\lambda=1$. Accordingly, $\alpha$ is set at a small value but the value of $Tp\times COEF$ is multiplied by the learning correction coefficient $\alpha o$ so as to correct the base air-fuel ratio. This learning correction coefficient $\alpha o$ is stored in the memory means 205.

Learning correction coefficient retrieval means 206 retrieves the learning correction coefficient $\alpha o$ from the memory means 205 according to the detected engine parameters, for example, Tp and N.

Learning correction coefficient renewal means 207 operates a new learning correction coefficient $\alpha$onew based on the feedback correction coefficient $\alpha$ set by the feedback correction coefficient setting means 202 and the learning correction coefficient $\alpha o$ retrieved by the learning correction coefficient retrieval means 206 according to the driving state of the engine, and said renewal means 207 sets this $\alpha$onew as the learning correction coefficient for the corresponding driving state of the engine in the memory means 205.

The new learning correction coefficient $\alpha$onew is arithmetically operated according to the weighted average of the stored learning correction coefficient $\alpha o$ and the set feedback correction coefficient $\alpha$, that is, $\alpha\text{onew}\rightarrow(\alpha+(M-1)\times\alpha o)/M$ or $\alpha\text{onew}\rightarrow\alpha o+\Delta\alpha/M$ [in which M is a constant and $\Delta\alpha$ is a deviation of the air-fuel ratio feedback correction coefficient $\alpha$ from a certain set standard value (ordinarily 1)]. Namely, in each case, the value $\alpha$onew is obtained by performing operation and correction while adding the newly set air-fuel feedback correction coefficient $\alpha$ to the previously written learning correction coefficient $\alpha o$. In short, $\alpha o$ is not directly substituted for $\alpha$.

The injection quantity operating means 203 receives $\alpha o$ before or after renewal, which has been retrieved by the learning correction coefficient retrieval means 206 and operates the injection quantity Ti by effecting change of $\alpha$ $\alpha o\times\alpha$. Accordingly, since $\alpha$ obtained at this time is rendered small because of the influence of $\alpha o$, the quantity of the feedback correction can be reduced and the response characteristics of the control of the air-fuel ratio can be improved.

Means 208 for detecting the stationary state of the engine puts out a signal to actuate the learning correction coefficient renewal means 207 when the means 208 detects the stationary state of the car based on the outputs of the throttle sensor 24, the crank angle sensor 31 and car speed sensor 35. Since the feedback correction coefficient $\alpha$ at the transient stage varies, this signal is eliminated.

The flow chart shown in FIG. 5 will now be described.

The operation routine shown in this flow chart is performed at every predetermined time unit.

In S101, the basic fuel injection quantity $Tp(=K\times Q/N)$ is arithmetically operated from the sucked air flow quantity Q obtained by the signal from the air flow meter 21 and the engine rotation speed N obtained by the signal from the crank angle sensor 31 at basic fuel injection quantity operating means 201.

In S102, various correction coefficients COEF are set.

In S103, the output voltage S3 of the $O_2$ sensor 26 is compared with the slice level voltage and the air-fuel ratio feedback correction coefficient $\alpha$ is set by the proportional integration control at air-fuel ratio feedback correction coefficient setting means 202.

In S104, the voltage correction quantity TS is set based on the battery voltage signal S11 from the battery 43.

In S105, the learning correction coefficient $\alpha o$ is retrieved from the engine rotation speed N and the basic injection quantity (load) Tp at learning correction coefficient retrieved means 205. The map of the learning correction coefficient $\alpha o$ to the rotation speed N and load Tp is stored in renewal-enable RAM 103, and when learning is not initiated, $\alpha o$ is equal to 1.

From S106 to S109 steps are arranged to detect the stationary state of the engine at means 208.

In S106, the change of the car speed is judged based on the signal S7 from the car speed sensor 35, and in S107, the engine speed is judged based on the signal S4, S5 from the crank angle sensor 31. In S108, the change of the opening degree of the throttle valve is judged based on the signal S2 from the throttle sensor 24, and in S109, it is decided whether or not the predetermined time has passed and if the predetermined time has not passed, the flow returns to S106. In the case where the change of the car speed within the predetermined time is below the predetermined value, the engine speed is in almost constant state and the opening degree of the throttle is below the predetermined value, it is decided that the engine is in the stationary state and correction of the learning correction coefficient in S110 and S111 is effected at the learning correction coefficient renewal means 207. In the case where at an optional point within the predetermined time, the change of the car speed exceeds the predetermined value, the engine speed in the changing state are or the change of the degree of the throttle exceeds the predetermined value, correction of the learning correction coefficient $\alpha o$ in S110 and S111 is not effected.

There may be considered a method in which the stationary state is detected based on the rich/lean inversion in the output of the $O_2$ sensor, the state of $\alpha$ and the engine parameters in combination. However, in view of matching with the response, it is easier to judge that the stationary state is attained if a predetermined time has passed from the point of attainment of the predetermined states in the change of the car speed, and the engine speed and the change of the opening degree of the throttle.

On judgement of the stationary state, the learning correction coefficient $\alpha o$ is corrected in the following manner.

In S110, the weighted average (see the equation given below) of the air-fuel ratio feedback correction coefficient at this time and the learning correction coefficient $\alpha o$ derived from the engine rotation speed N and the load Tp is determined, and this weighted average value is adopted as the new learning correction coefficient $\alpha o$:

$$\alpha o \leftarrow (\alpha + (M-1) \times \alpha o)/M$$

in which M is a constant.

In S111, the new learning correction coefficient $\alpha o$ is written in the corresponding engine rotation speed N and load Tp of RAM 103. In short, data in RAM are renewed.

After correction of the learning correction coefficient $\alpha o$ on judgement of the stationary state, or after judgement of the transient state, in S112 the injection quantity Ti is arithmetically operated according to the following equation:

$$Ti = Tp \times COEF \times \alpha \times o + TS$$

In case of the stationary state, the renewed value is used as $\alpha o$, and in case of the transient state, the retrieved value is used as it is.

In view of matching, it is preferred that the map of the learning correction coefficient stored in RAM should comprise about 8 lattices for the engine rotation speed N and about 4 lattices for Tp. In connection with the renewal of $\alpha o$, it is considered preferable that correction of areas determined by these lattices should not be effected but appropriate correction should be performed on operating of Ti at fuel injection quantity operating means.

Instead of the method in which parameters to be corrected by the learning control are separately set, there may be adopted a method in which the K constant, the Q-Us (air flow meter output), the Kmr map and the like are corrected. Incidentally, in the case where the so-called single point injection system where the fuel is injected on one point upstream of the throttle valve is adopted and a hot-wire type air flow meter is arranged in an air passage by-passing the throttle valve to measure the sucked air quantity, there is a possibility that the influence of the measurement error will be changed by the engine rotation and boost, and therefore, it is considered preferable to perform correction by the Kmr map. In this case, there may be considered a method in which the Kmr map per se is corrected and a method in which the Kmr map determined by matching is fixed to ROM and a calibration Kmr map is separately set. In view of matching for setting the air-fuel ratio feedback control region, the latter method is considered advantageous. Therefore, it is preferred that the calibration Kmr map for the learning control be set on CMOS-RAM.

In the case where the above-mentioned learning control is performed, in order to store and retain the content of the learning control, needless to say, backing-up of RAM 103 is performed even after the ignition switch has been turned off, and for this purpose, a back-up battery circuit is used. The reason why CMOS-RAM 103 is used is that the necessary retention current is small.

Since the learning control is a system in which control parameters are spontaneously corrected, it is necessary to always monitor whether or not learning is possible in the system. If this monitoring is not effected, there is a possibility that learning will be advanced in a direction different from the intended direction.

In order to perform learning of the air-fuel ratio, it is indispensable that the output of the $O_2$ sensor should be normal. Therefore, it is necessary to always check whether or not the $O_2$ sensor is in the state where learning is possible.

For this purpose, there may be used a monitor for deciding whether or not the electromotive force of the $O_2$ sensor is in the normal range, or a monitor for deciding whether or not the frequency of the rich/lean inversion in the closed state is in the normal range.

As is apparent from the foregoing description, in the present embodiment, since the air-fuel ratio feedback correction coefficient is learned at the time of the feedback control to set the learning correction coefficient and by using this coefficient the base air-fuel ratio of the air-fuel ratio feedback control zone is controlled to $\lambda=1$ by learning, the deviation from $\lambda=1$ due to the level difference of the base air-fuel ratio at the transient stage can be eliminated and the PI component constant at the time of the air-fuel ratio feedback control can be reduced, with the result that the control characteristics can remarkably be improved. Accordingly, the catalyst can be used in the region where the conversion efficiency is high, and the amount of the noble metal is reduced to reduce the cost and exchange of the catalyst becomes unnecessary. Furthermore, since learning is performed in the stationary state, the reliability of learning is greatly increased.

Incidentally, in the foregoing embodiment, as is apparent to those skilled in the art, the P component may be excluded from the PI component constant at the time of the air-fuel ratio feedback control or a part of the I component may be regarded as this PI component constant.

Figure 6:
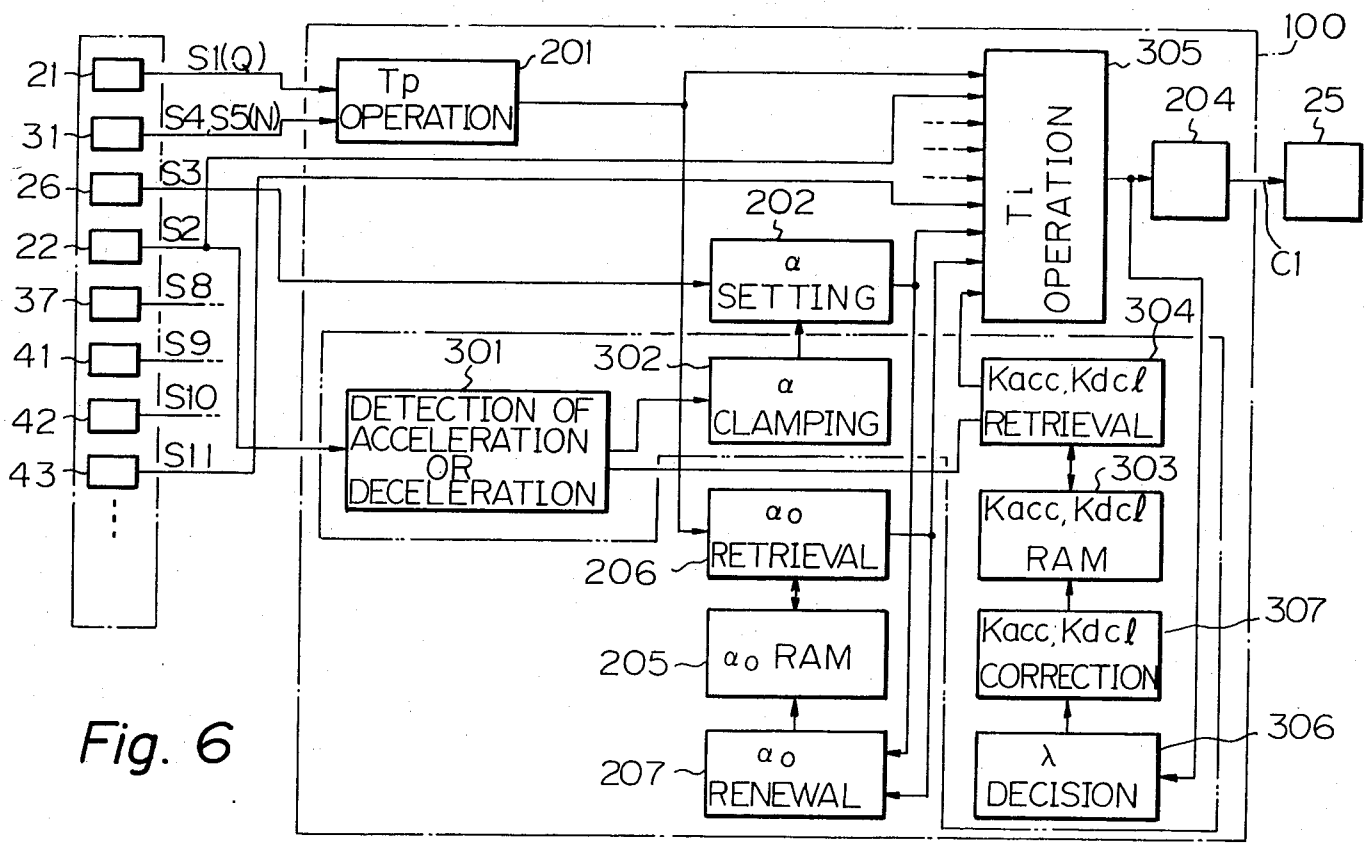
FIG. 6 is a block diagram in the air-fuel ratio learning control apparatus of another embodiment of the present invention at the stationary state and at the time of acceleration or deceleration of the engine.

FIG. 6 illustrates another embodiment of the present invention. In this embodiment, at the time of acceleration or deceleration of the engine, the feedback control of the air-fuel ratio is stopped and the fuel injection quantity is increased or decreased for acceleration or deceleration. This embodiment is different from the first embodiment only in the area surrounded by a two-dot chain line. Accordingly, only the portion of this area will now be described.

Acceleration or deceleration detecting means 301 computes the rate of the change of the opening degree of the throttle valve 22, which is put out by the throttle sensor 24 and detects that the engine is in the accelerated state or the decelerated state.

Clamping means 302 is means for clamping the feedback correction coefficient $\alpha$ in the feedback correction coefficient setting means 202 when the accelerated or decelerated state of the engine is detected and stopping the feedback control. The means 208 for detecting the stationary state of the engine, shown in FIG. 3, may be omitted if the acceleration or deceleration detecting means 301 and clamping means 302 are thus arranged.

Memory means (RAM) 303 is renewal-enable memory means in which the acceleration correction coefficient Kacc and deceleration correction coefficient Kdcl for increasing or decreasing and correcting the injection quantity at the time of acceleration or deceleration according to the driving state of the engine are preliminarily stored in the form of a map.

Acceleration or deceleration correction coefficient retrieval means 304 retrieves the acceleration correction coefficient Kacc or deceleration correction coefficient Kdcl from the memory means 303 according to the detection signals from various engine driving state detecting means 24, 26, 37, 41, 42 and 43 when the detecting means 301 detects acceleration or deceleration of the engine.

Injection quantity operating means 305 has a function of performing increase or decrease correction of the fuel injection quantity at the time of acceleration or deceleration in addition to the function of the fuel injection quantity operating means 203 shown in FIG. 3. Namely, the operating means 305 receives the feedback correction coefficient set by the feedback correction setting means 202, the learning correction coefficient retrieved by the learning correction coefficient retrieval means 206 and the above-mentioned retrieved coefficient Kacc or Kdcl and operates the injection quantity Ti according to the equations of $Ti=Tp\times COEF\times\alpha o\times\alpha+TS$ and $COEF=1+Kwt+Kas+Kai+Kmr+Kacc+Kdcl$. Thus, the air-fuel ratio feedback control performed based on learning correction of the base air-fuel ratio is stopped at the time of acceleration or deceleration, and instead, the fuel injection quantity is increased or decreased based on the acceleration correction coefficient Kacc or deceleration correction coefficient Kdcl.

Because of the deviation of Kacc or Kdcl at the transient stage and the change of Kacc or Kdcl with the lapse of time, there is sometimes brought about a disadvantage of a substantial change of the acceleration or deceleration correction coefficient Kacc or Kdcl stored in the memory means 303 according to the driving state at the time of acceleration or deceleration.

Air-fuel ratio deciding means 306 operates the actual air-fuel ratio $\lambda$ of the air-fuel mixture based on the fuel injection quantity Ti computed by the computing means 305 and the sucked air flow amount Q detected by the air flow meter 21 at the time of acceleration or deceleration of the engine. This operated actual air-fuel ratio $\lambda$ is compared with the predetermined aimed air-fuel ratio $\lambda t$ and the difference between the two air-fuel ratios is determined.

Acceleration or deceleration correction coefficient renewal means 307 operating an acceleration or a deceleration correction coefficient Kacc or Kdcl for eliminating the above difference based on the result of the decision by the deciding means 306 and Kacc or Kdcl in the corresponding driving state, stored in the memory means 303, is replaced by this new Kacc or Kdcl.

Accordingly, in the subsequent same acceleration or deceleration driving state, the fuel injection quantity operating means 305 operates the injection quantity Ti based on this new Kacc or Kdcl.

Figures 7, 7A, 7B:
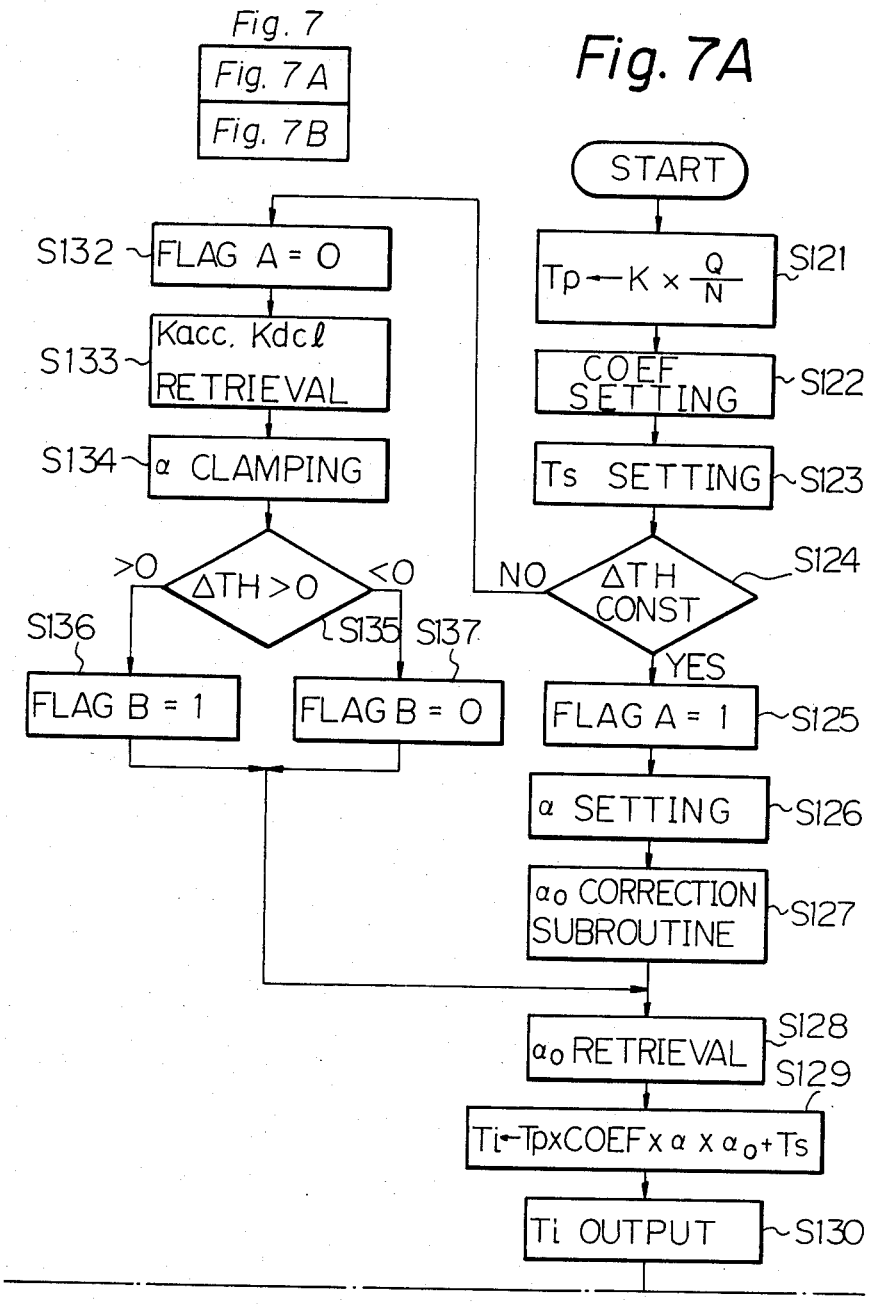
FIGS. 7, 7A and 7B are a flow chart showing operations of the air-fuel ratio learning control apparatus shown in FIG. 6.
Figure 7B:
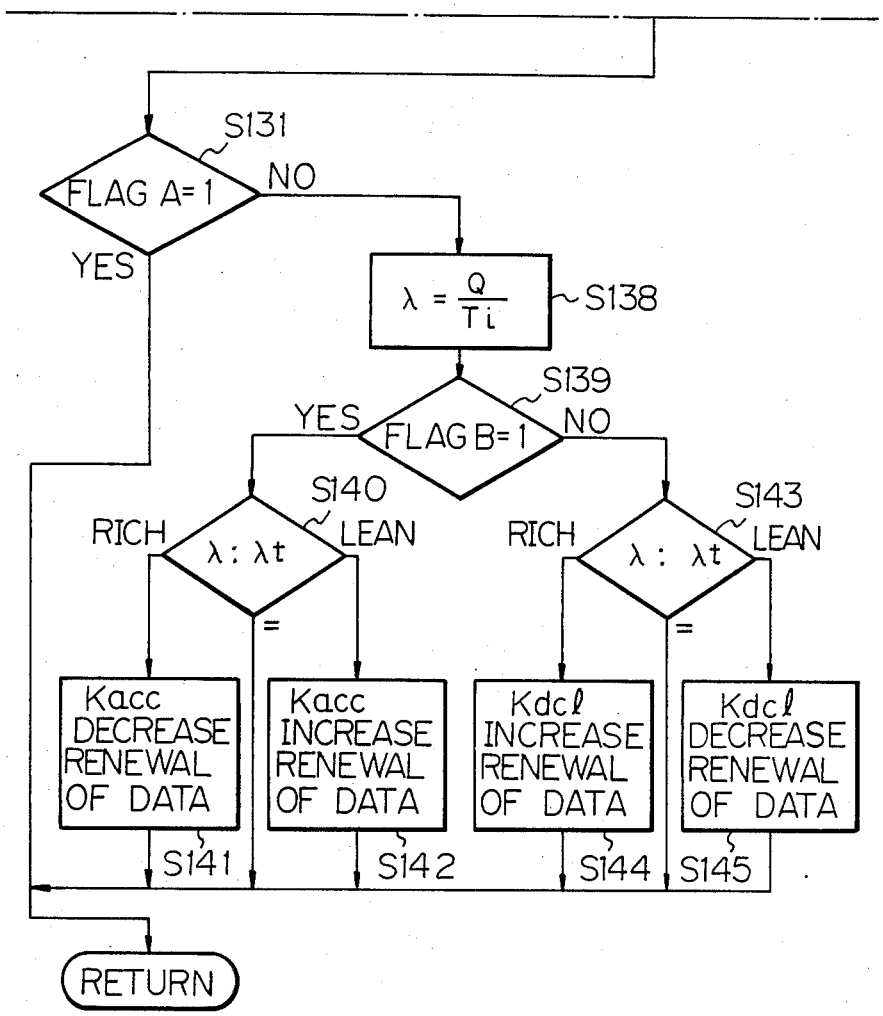

The flow chart of FIG. 7 will now be described.

In S121, the basic injection quantity Tp is operated from the sucked air flow quantity Q given by the signal from the air flow meter 21 and the engine rotation speed N given by the signal from the crank angle sensor 31.

In S122, various correction coefficients COEF are set, and in S123, the voltage correction quantity TS is set by the battery voltage from the battery 43.

In S124, it is detected whether the engine is in the accelerated state or in the decelerated state. Acceleration or deceleration is detected by detecting the change $\Delta TH$ of the throttle opening degree TH based on the signal from the throttle sensor 24 at the detection means 301.

In S125, when $\Delta TH$ is constant, it is judged that the engine is in the stationary state, and FLAGA is set at 1.

Figure 5:
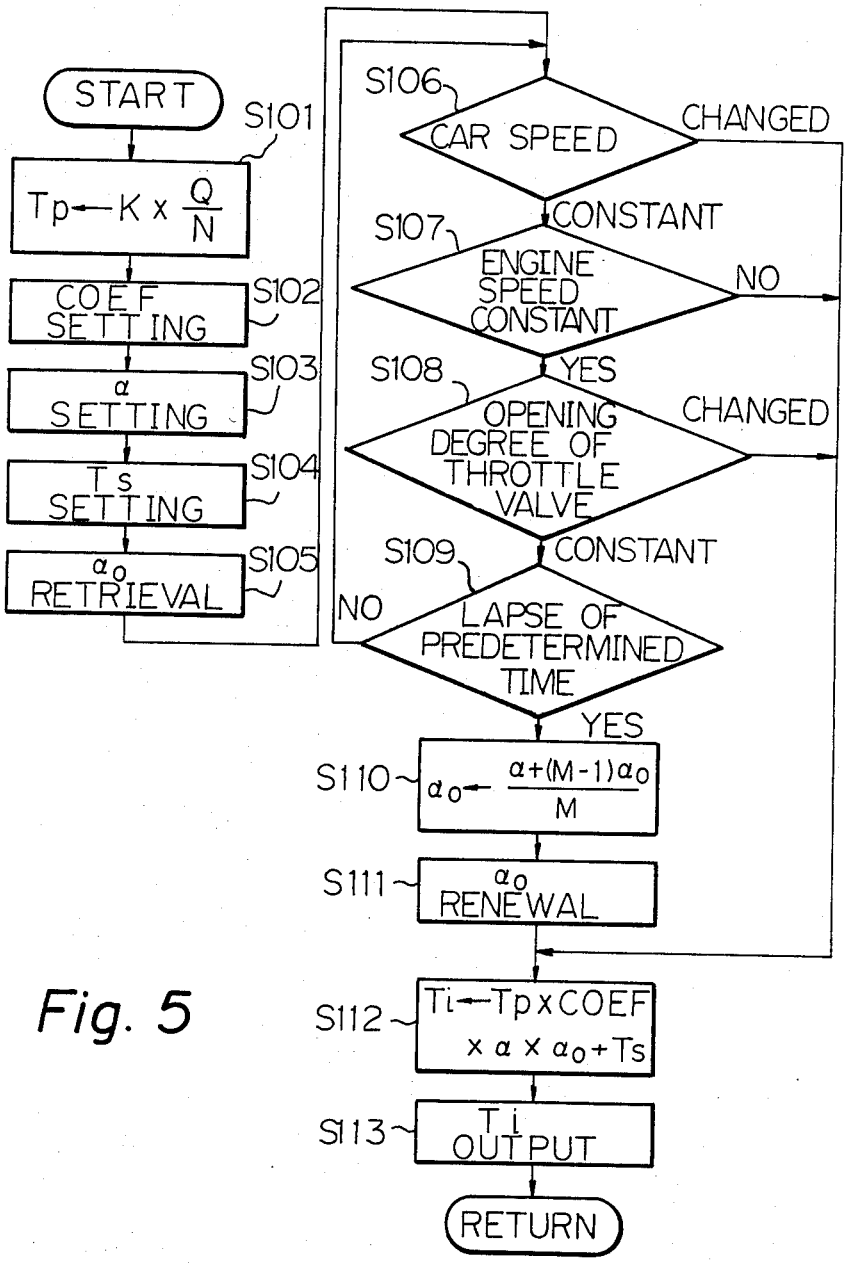
FIG. 5 is a flow chart showing operations of the air-fuel ratio learning control apparatus shown in FIG. 3.

In S126 through S130, the control steps are advanced in the same manner as in S101 through S112 in the embodiment shown in FIG. 5. Incidentally, the sub-routine for correction of $\alpha o$ in S127 is performed in S110 and S111 shown in FIG. 5. Thus, the operation routine for the feedback control of the injection quantity Ti in the stationary state of the engine is constructed, and as in the preceding embodiment, the fuel is injected and supplied from the fuel injection valve 25 through S130.

If it is decided in S124 that $\Delta TH$ is not constant, FLAGA is set at 0 in S132, and in S133, the acceleration correction coefficient Kacc or deceleration correction coefficient Kdcl is retrieved based on the throttle opening degree TH from the memory means 303, its change TH, the engine rotation speed N and the basic injection quantity (load) Tp, which are parameters indicating the driving state of the engine. Incidentally, the map of the acceleration correction coefficient Kacc or deceleration correction coefficient Kdcl corresponding to the driving state of the engine is stored in RAM 103, and when learning is not initiated, for example, Kacc and Kdcc are set at 1.1 and 0.9, respectively.

Then, in S134 and at the clamping means 302, the feedback correction coefficient $\alpha$ is clamped to stop the feedback control in the transient state.

In S135, it is detected whether $\Delta TH$ is positive or negative, and if it is detected that $\Delta TH$ is positive, it is decided that the engine is in the accelerated state and FLAGB is set at 1 in S137. If it is detected that $\Delta TH$ is negative, it is decided that the engine is in the decelerated state and the FLAGB is set at 0 in S137.

In S129, the learning correction coefficient $\alpha o$ in the $\alpha$-fixed state is retrieved, and in S130, the injection quantity Ti at the transient stage is put out.

When it is detected in S131 that FLAGB is not set at 1 and the engine is in the accelerated or decelerated state, the flow advances to S138.

After S138, learning of the base air-fuel ratio at the transient stage is conducted, and the acceleration or deceleration correction coefficient Kacc or Kdcl is corrected at the correction means 307.

In S138, the air-fuel ratio $\lambda(A/F=Q/Ti)$ is operated from the sucked air flow quantity Q and the injection quantity Ti.

In S139, FLAGB is checked, and if FLAGB is 1, it is judged that the engine is in the accelerated state and if FLAGB is 0, it is judged that the engine is in the decelerated state.

In the case where it is judged that the engine is in the accelerated state, in S140, the detected air-fuel ratio $\lambda$ is compared with the aimed value $\lambda t$, and if $\lambda$ is richer than $\lambda t$, in S141, the acceleration correction coefficiency Kacc is corrected to a smaller side (brought close to 1). If λ is leaner than λt, in S142, the acceleration correction coefficient Kacc is corrected to a larger side at the correction means 307.

In the case where the engine is in the decelerated state, in S143, λ is compared with λt, and when λ is richer than λt, in S144, the deceleration correction coefficient Kdcl is corrected to a larger side. When λ is leaner than λt, in S145, the deceleration correction coefficient is corrected to a smaller side (brought close to 1).

Of course, the acceleration or deceleration correction coefficient Kacc or Kdcl which has thus been corrected so that the air-fuel ratio λ at the transient stage becomes equal to the aimed value λt is written in the corresponding engine driving state in RAM 3, and data in RAM 3 are renewed. These data of Kacc and Kdcl are used for subsequent setting of COEF.

The aimed at air-fuel ratio λt is determined while adding the response delay by the adhesion of the fuel of the wall surface of the suction tube and the flow-in speed of the air-fuel mixture to the basic aimed air-fuel ratio.

Incidentally, correction of the acceleration or deceleration correction coefficient may be accomplished by correcting the acceleration or deceleration correction coefficient per se. Alternatively, there may be adopted a method in which a calibration map for correcting the matched acceleration or deceleration correction coefficient according to such parameters as N and Tp is arranged and correction is performed by using this map.

For example, the equation of Kacc←Kacc×K1×K2×K3×KM is set, and in the fixed map, Kacc, K1, K2 and K3 are retrieved from the throttle opening degree TH, the change ΔTH of the throttle opening degree TH, the engine rotation speed N and the water temperature TSW, respectively, and KM is retrieved from the engine rotation speed N and load Tp in the calibration map for the learning control. In this case, it is preferred that the calibration map should have about 4×4 lattices.

Instead of the above-mentioned method in which A/F is calculated from the sucked air flow quantity 0 and injection quantity Ti and is compared with the aimed value, the following method may be adopted for the decision of the air-fuel ratio at the transient stage.

Namely, α of the air-fuel control at the transient stage is integrated by using a value different from the ordinary I compornent unit (ordinarily, a value slower than the I component unit to operate α', and the acceleration or deceleration correction coefficient is corrected by this λ'. In this case, it is considered that the control speed of α' should be changed depending on whether it is on the rich base of the $O_2$ sensor or on the lean base thereof that the engine enters into the transient stage.

As is apparent from the foregoing description, according to the present invention, also with respect to correction of acceleration or deceleration for improving the respondency at the transient stage, the air-fuel ratio can be controlled by learning and the control can be performed stably.

What is claimed is:

1. An apparatus for learning control of an air-fuel ratio of an air-fuel mixture in an electronically controlled fuel injection type internal combustion engine, which comprises means for detecting a driving state of the engine, which includes at least first detecting means for detecting a flow quantity Q of air sucked in the engine, second detecting means for detecting a rotation speed N of the engine and third detecting means for detecting a concentration of the exhaust component so as to detect the actual air-fuel ratio λ of the air-fuel mixture sucked in the engine based on the detected concentration of the exhaust component, fuel injection means for injecting and supplying a fuel to the engine in an on-off manner in response to a driving pulse signal, basic fuel injection quantity operating means for operating a basic fuel injection quantity Tp of the fuel to be supplied to the engine based on the flow quantity Q of air sucked in the engine, which is put out by said first detecting means, and the engine rotation speed N put out by said second detecting means, random access memory means in which the learning correction coefficient αo for correcting said basic fuel injection quantity Tp is pre-stored in advance according to the driving state of the engine, learning correction coefficient retrieval means for retrieving the learning correction coefficient αo from said memory means according to the actually detected driving state of the engine, feedback correction coefficient setting means for increasing or decreasing by at least a predetermind integration component unit a feedback correction coefficient α so that the actual air-fuel ratio λ put out by said third detecting means is brought close to the present aimed air-fuel ratio λt, learning correction coefficient renewal means for setting a new learning correction coefficient, which is operating based on the feedback correction coefficient α set by said feedback correction coefficient setting means and the learning correction coefficient αo retrieved by said learning correction coefficient retrieval means according to the detected driving state of the engine, as the corresponding learning correction coefficient αo of said memory means, fuel injection quantity operating means for operating a fuel injection quantity Ti by correcting the basic fuel injection quantity Tp based on the retrieved or retrieved and renewed learning correction coefficient αo and also based on the feedback correction coefficient α set by said feedback correction coefficient setting means, and driving pulse signal output means for putting out the driving pulse signal corresponding to the fuel injection quantity Ti to said fuel injection means, wherein said means for detecting the driving state of the engine comprises fourth detecting means for detecting a stationary state of the engine and said learning correction coefficient renewal means is actuated when the engine is in the stationary state, said fourth detecting means including car speed detecting means, engine speed detecting means and means for detecting an opening degree of a throttle valve arranged in an intake passage of the engine, and when it is detected that the state in which the car speed and the engine speed are constant and the opening degree of the throttle valve is constant for a predetermined time, it is determined that the engine is in the stationary state.

2. An apparatus for learning control of an air-fuel ratio mixture in an electronically controlled fuel injection type internal combustion engine, which comprises means for detecting a driving state of the engine, which includes at least first detecting means for detecting a flow quantity Q of air sucked in the engine, second detecting means for detecting a rotation speed N of the engine and third detecting means for detecting a concentration of the exhaust component so as to detect the actual air-fuel ratio λ of the air-fuel mixture sucked in the engine based on the detected concentration of the exhaust component, fuel injection means for injecting and supplying a fuel to the engine in an on-off manner in response to a driving pulse signal, basic fuel injection quantity operating means for operating a basic fuel injection quantity Tp of the fuel to be supplied to the engine based on the flow quantity Q of air sucked in the engine, which is put out by said first detecting means, and the engine rotation speed N put out by said second detecting means, random access memory means in which the learning correction coefficient λo for correcting said basic fuel injection quantity Tp is pre-stored in advance according to the driving state of the engine, learning correction coefficient retrieval means for retrieving the learning correction coefficient αo from said memory means according to the actually detected driving state of the engine, feedback correction coefficient setting means for increasing or decreasing by at least a predetermined integration component unit a feedback correction coefficient α so that the actual air-fuel ratio λ put out by said third detecting means is brought close to the present aimed air-fuel ratio λt, learning correction coefficient renewal means fo setting a new learning correction coefficient, which is operating based on the feedback correction coefficient α set by said feedback correction coefficient setting means and the learning correction coefficient αo retrieved by said learning correction coefficient retrieval means according to the detected driving state of the engine, as the corresponding learning correction coefficient αo of said memory means, fuel injection quantity operating means for operating a fuel injection quantity Ti by correcting the basic fuel injection quantity Tp based on the retrieved or retrieved and renewed learning correction coefficient αo and also based on the feedback correction coefficient α set by said feedback correction coefficient setting means, and driving pulse signal output means for putting out the driving pulse signal corresponding to the fuel injection quantity Ti to said fuel injection means, wherein said learning correction coefficient renewal means comprises means for setting a new learning correction coefficient according to the equation of $\alpha o \leftarrow \alpha o + \Delta\alpha/M$ in which $\Delta\alpha$ is a deviation of the feedback correction coefficient α from the set standard value and M is a constant.

3. An apparatus for learning control of an air-fuel ratio of an air-fuel mixture in an electronically controlled fuel injection type internal combustion engine, which comprises means for detecting a driving state of the engine, which includes at least first detecting means for detecting a flow quantity Q of air sucked in the engine, second detecting means for detecting a rotation speed N of the engine, third detecting means for detecting a concentration of the exhaust component so as to detect the actual air-fuel ratio λ of the air-fuel mixture sucked in the engine and fourth detecting means for detecting acceleration or deceleration of the engine, fuel injection means for injecting and supplying a fuel to the engine in an on-off maner in response to a driving pulse signal, basic fuel injection quantity determining means for operating a basic injection quantity Tp of the fuel to be supplied to the engine based on the flow quantity Q of air sucked in the engine, which is put out by said first detecting means, and the engine rotation speed N put out by said second detecting means, random access first memory means in which the learning correction coefficient αo for correcting said basic fuel injection quality Tp is prestored in advance according to the driving state of the engine, learning correction coefficient retrieval means for retrieving the learning correction coefficient αo from said first memory means according to the actually detected driving state of the engine, feedback correction coefficient setting means for increasing or decreasing by at least a predetermined integration component unit a feedback correction coefficient α so that the actual air-fuel ratio λ put out by said third detecting means is brought close to the present target air-fuel mixture λt, learning correction coefficient renewal means for setting a new learning correction coefficient, which is operated based on the feedback correction coefficient α set by said feedback correction coefficient setting means and the learning correction coefficient αo retrieved by said learning correction coefficient retrieval means according to the detected driving state of the engine, as the corresponding learning correction coefficient αo of said first memory means, clamping means for clamping the feedback correction coefficient α of the feedback correction coefficient setting means when acceleration or deceleration of the engine is detected by said fourth detecting means and stopping the feedback control, random access second memory means in which acceleration and deceleration correction coefficients Kacc and Kdcl for increasing or decreasing and correcting the fuel injection quantity at the time of acceleration or deceleration according to the driving state of the engine are pre-stored in advance, acceleration and deceleration correction coefficient retrieval means for retrieving the acceleration or deceleration correction coefficient Kacc or Kdcl from said second memory means according to the driving state of the engine when acceleration or deceleration of the engine is detected by said fourth detecting means, fuel injection quantity operating means for operating a fuel injection quantity Ti by correcting the basic fuel injection quantity Tp based on the retrieved or retrieved and renewed learning correction coefficient αo, the feedback correction coefficient α set by said feedback correction coefficient setting means and the retrieved acceleration or deceleration correction coefficient Kacc or Kdcl, driving pulse signal output means for putting out the driving pulse signal corresponding to the fuel injection quantity Ti to said fuel injection means, air-fuel ratio deciding means for operating the air-fuel ratio of the air-fuel mixture at the time when acceleration or deceleration of the engine is detected by said fourth detecting means and comparing the operated air-fuel ratio with the target air-fuel ratio corresponding to the driving state of the engine, and acceleration and deceleration correction coefficient renewal means for renewing the acceleration or deceleration correction coefficient to the new acceleration or deceleration correction coefficient corresponding to the driving state of the engine, which is stored in said second memory means, based on the result of the decision made by said deciding means so that the deviation of the operated air-fuel ratio from the target air-fuel ratio is eliminated, said fourth detecting means comprising means for detecting that a change of the opening degree of a throttle valve arranged on an intake passage of the engine exceeds a predetermined value, said fourth detecting means further comprising means responsive to change of car speed within a predetermined time period and to change of engine speed, together with said means for detecting the opening degree of said throttle valve, for detecting said acceleration or deceleration of the engine.

4. An apparatus for learning control of the air-fuel ratio of an air-fuel mixture in an electronically controlled fuel injection type internal combustion engine according to claim 1, wherein said third detecting means comprises an $O_2$ sensor for detecting the $O_2$ concentration in the exhaust gas from the engine and comparator means for comparing the output voltage of the $O_2$ sensor with a predetermined slice level signal.

5. An apparatus for learning control of the air-fuel ratio of an air-fuel mixture in an electronically controlled fuel injection type internal combustion engine according to claim 1, wherein said basic fuel injection operating means comprises means for operating the basic fuel injection quantity Tp according to the equation of $Tp=K.Q/N$ in which K is a constant.

6. An apparatus for learning control of the air-fuel ratio of an air-fuel mixture in an electronically controlled fuel injection type internal combustion engine according to claim 1, wherein said memory means comprises means for storing therein the learning correction coefficient $\alpha o$ corresponding to the basic fuel injection quantity Tp and the engine speed N.

7. An apparatus for learning control of the air-fuel ratio of an air-fuel mixture in an electronically controlled fuel injection type internal combustion engine according to claim 1, wherein said memory means includes a back-up power source circuit for retaining the content of the memory even while the engine is stopped.

8. An apparatus for learning control of the air-fuel ratio of an air-fuel mixture in an electronically controlled fuel injection type internal combustion engine according to claim 1, wherein said feedback correction coefficient setting means comprises means for setting the feedback correction coefficient $\alpha$ by increasing or decreasing it by a predetermined integration component unit or a predetermined proportional component larger than the integration component unit.

9. An apparatus for learning control of the air-fuel mixture ratio of an air-fuel mixture in an electronically controlled fuel injection type internal combustion engine according to claim 2, wherein said learning correction coefficient renewal means comprises means for setting a weighted average of the feedback correction coefficient $\alpha$ and the learning correction coefficient $\alpha o$ as a new learning correction coefficient.

10. An apparatus for learning control of the air-fuel ratio of an air-fuel mixture in an electronically controlled fuel injection type internal combustion engine according to claim 2, wherein the said fuel injection quantity operating means comprises means for operating the fuel injection quantity Ti based on the value obtained by multiplying the basic fuel injection quantity Tp by the retrieved learning correction coefficient $\alpha o$ and the feedback correction coefficient $\alpha$.

11. An apparatus for learning control of the air-fuel ratio of an air-fuel mixture in an electronically controlled fuel injection type internal combustion engine according to claim 2, wherein said third detecting means comprises an $O_2$ sensor for detecting the $O_2$ concentration in the exhaust gas from the engine and comparator means for comparing the output voltage of the $O_2$ sensor with a predetermined slice level signal.

12. An apparatus for learning control of the air-fuel ratio of an air-fuel mixture in an electronically controlled fuel injection type internal combustion engine according to claim 2, wherein said basic fuel injection operating means comprises means for operating to basic fuel injection quantity Tp according to the equation of $Tp=K\cdot Q/N$ in which K is a constant.

13. An apparatus for learning control of the air-fuel ratio of an air-fuel mixture in an electronically controlled fuel injection type internal combustion engine according to claim 2, wherein said memory means comprises means for storing therein the learning correction coefficient corresponding to the basic fuel injection quantity Tp and the engine speed N.

14. An apparatus for learning control of the air-fuel ratio of an air-fuel mixture in an electronically controlled fuel injection type internal combustion engine according to claim 2, wherein said memory means includes a back-up power source circuit for retaining the content of the memory even while the engine is stopped.

15. An apparatus for learning control of the air-fuel ratio of an air-fuel mixture in an electronically controlled fuel injection type internal combustion engine according to claim 2, wherein said feedback correction coefficient setting means comprises means for setting the feedback correction coefficient $\alpha$ by increasing or decreasing it by a predetermined integration component unit or a predetermined proportional component larger than the integration component unit.

16. An apparatus for learning control of the air-fuel ratio of an air-fuel mixture in an electronically controlled fuel injection type internal combustion engine according to claim 1, wherein said learning correction coefficient renewal means comprises means for setting a weighted average of the feedback correction coefficient $\alpha$ and the learning correction coefficient $\alpha o$ as a new learning correction coefficient.

17. An apparatus for learning control of the air-fuel ratio of an air-fuel mixture in an electronically controlled fuel injection type internal combustion engine according to claim 1, wherein said fuel injection quantity operating means comprises means for operating the fuel injection quantity Ti based on the value obtained by multiplying the basic fuel injection quantity Tp by the retrieved learning correction coefficient $\alpha o$ and the feedback correction coefficient $\alpha$.

18. An apparatus for learning control of the air-fuel ratio of an air-fuel mixture in an electronically controlled fuel injection type internal combustion engine according to claim 3, wherein said fuel injection quantity operating means is means for operating the fuel injection quantity Ti based on a value obtained by multiplying the basic fuel injection quantity Tp by the retrieved learning correction coefficient $\alpha o$, the feedback correction coefficient $\alpha$ and the acceleration or deceleration correction coefficient Kacc or Kdcl.

* * * * *